US006655731B2

(12) United States Patent
Martin

(10) Patent No.: US 6,655,731 B2
(45) Date of Patent: Dec. 2, 2003

(54) THERAPEUTIC CHAIR

(75) Inventor: Charles N. Martin, 2045 rue Principal, Val des Monts, Quebec (CA), J8N 2J9

(73) Assignee: Charles N. Martin, Ottawa (CA)

( * ) Notice: Subject to any disclaimer, the term of this patent is extended or adjusted under 35 U.S.C. 154(b) by 0 days.

(21) Appl. No.: 10/245,504

(22) Filed: Sep. 18, 2002

(65) Prior Publication Data

US 2003/0057757 A1 Mar. 27, 2003

(30) Foreign Application Priority Data

Sep. 26, 2001 (CA) ..... 2357902

(51) Int. Cl.[7] ..... A47C 4/00; A47C 1/022

(52) U.S. Cl. ..... 297/23; 297/56; 297/92; 297/337; 297/338; 297/354.11; 297/283.2; 297/353

(58) Field of Search ..... 297/338, 337, 297/16.1, 23, 35, 56, 92, 93, 423.12, 423.13, 283.1, 283.2, 313, 354.1, 354.11, 353

(56) References Cited

U.S. PATENT DOCUMENTS 3,669,493 A * 6/1972 Vowles ..... 297/423.11
4,589,699 A 5/1986 Dungan
4,614,378 A * 9/1986 Picou ..... 297/92
4,765,684 A 8/1988 Kvalheim et al.
4,767,159 A 8/1988 Opsvik
4,793,655 A 12/1988 Kvalheim et al.
5,054,857 A 10/1991 Kvalheim
5,123,697 A * 6/1992 Szczurek ..... 297/23
5,186,519 A 2/1993 Larson
5,378,040 A * 1/1995 Chaney et al. ..... 297/338 X
5,618,250 A 4/1997 Butz

FOREIGN PATENT DOCUMENTS

CA 1281988 3/1991
CA 2066591 3/1991

* cited by examiner

*Primary Examiner*—Anthony D. Barfield
(74) *Attorney, Agent, or Firm*—Shapiro Cohen; Robert G. Hendry

(57) ABSTRACT

An orthopaedic chair including a frame for supporting a contoured chair seat and chair back; each of which is mounted for rotation on a horizontal axis. Horizontal adjustment for the axis of the chair seat and vertical adjustment for the axis of the chair back are provided thereby holding the person in an orthopaedically beneficial position. The orthopaedic chair may be in the form of an arm chair or folding camp chair.

3 Claims, 6 Drawing Sheets

THERAPEUTIC CHAIR

FIELD OF THE INVENTION

This invention relates to adjustable chairs and more particularly an Orthopaedic seating system for use on chairs for home or leisure activities.

BACKGROUND OF THE INVENTION

A great deal of emphasis has been placed on providing work place chairs of the sit kneel type as disclosed in U.S. Pat. No. 4,589,699.

The ergonomic work place chair of U.S. Pat. No. 5,186,519 further provides seat and back portions which tilt about their respective, horizontal axes so that the sitter's sacrum region will be contacted and supported.

The present invention is concerned with providing seat and back portions pivotally mounted on the frame of an arm chair for use in the home or office. The pivotally mounted seat and back portions of this invention are also capable of being mounted on a portable chair for leisure activities such as camping, or outdoor entertainment.

The present invention also provides a contoured seat and back to aid in relieving discomfort and restoring lumbar lordoses. The orthopaedic chairs of this invention are readily adjustable by changing vertical and horizontal positions of the seat and back to fit most skeletal structures through the action of providing supports for seat and back assemblies of the chair specific orthopaedic capabilities are achieved, namely the ability to hold a person in an orthopaedically correct posture for assessment and treatment, the ability to relax both upper and lower (Spinal) extensor muscles, the ability to decompress the anterior column of the spine and give the user the ability to do his back extension exercise without hip extension.

A seated person may also stretch out and lean back and this seating system allows for full orthopaedically correct lumbar support both during this movement, and in a fully extended position. Specifically designed for people who suffer from back problems, this seating system offers relief from lower back pain as it allows the bottom of the spine to hang freely rather than be the foundation and support for the upper body while sitting on an ordinary chair seat.

SUMMARY OF THE INVENTION

Accordingly this present invention seeks to provide an orthopaedic chair for a person suffering from back problems a chair seat, a chair back frame for supporting the chair seat and the back, the seat being mounted for rotation about a first horizontal axis the chair back mounted for rotation about a second horizontal axis, means to provide horizontal adjustments of the first axis and the seat, means to provide vertical adjustment of the first axis and the seat, means to provide vertical adjustment of the chair back including vertical adjustment of the second axis, the chair seat and chair back being adjusted to suit an individual sitting in the chair thereby holding the person in an orthopaedically person beneficial position.

The present invention seeks to provide a further embodiment wherein the chair is a folding chair and said frame comprises spaced apart sides, each side including first and second elongated members joined intermediate their ends by pivot means and members interconnecting the spaced apart sides.

The present invention also seeks to provide an orthopaedic chair wherein the said frames comprise spaced apart sides each side: including first and second upright members joined by at least one horizontal member and horizontal members interconnecting the spaced apart sides.

DETAILED DESCRIPTION OF THE DRAWINGS

Figure 1:
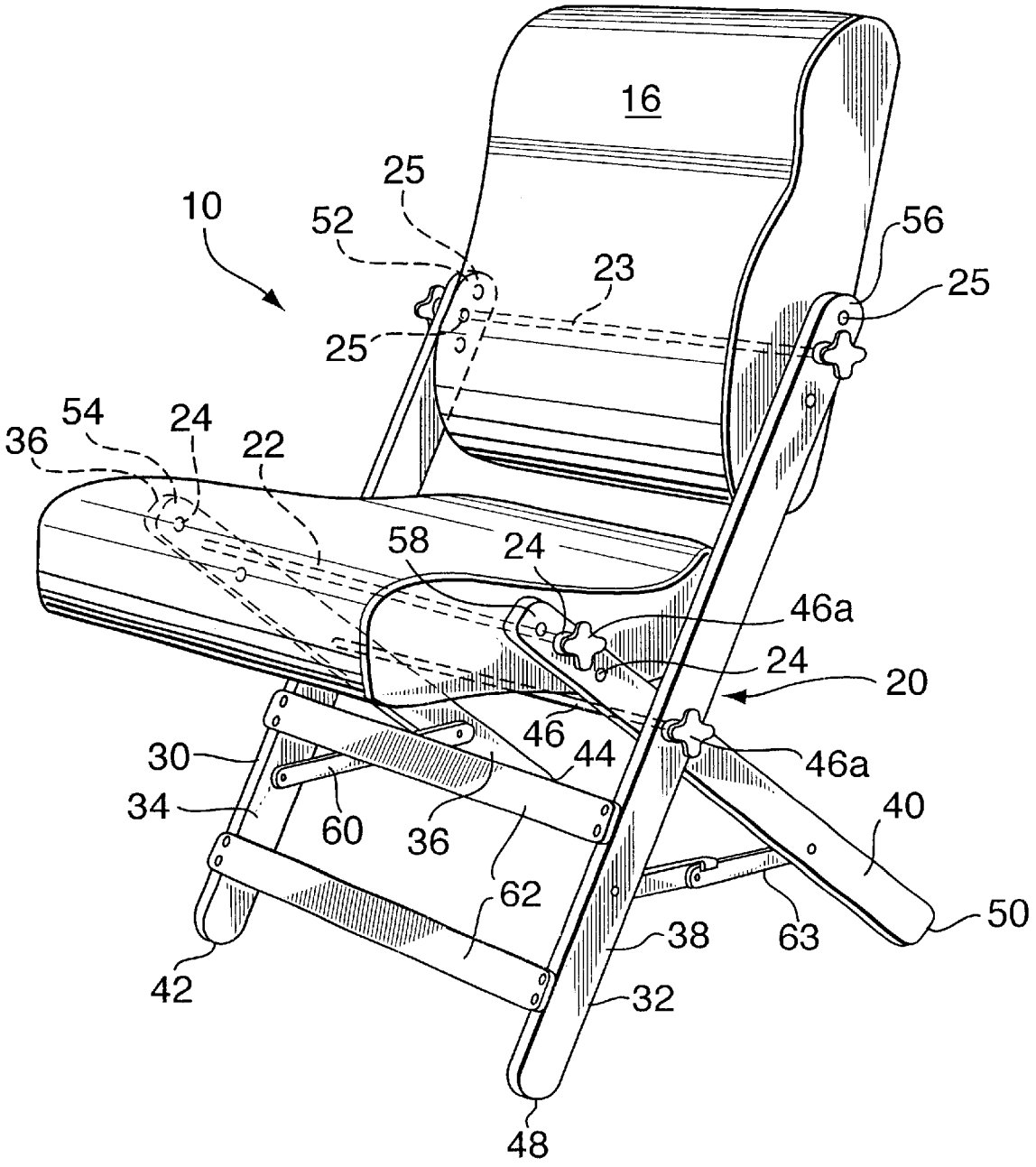
FIG. 1 is a perspective view of the orthopaedic chair in the form of a folding chair.

An orthopaedic folding chair in accordance with this invention shown generally at 10 in FIG. 1 includes a chair seat 14, a chair back 16 and a frame shown generally at 20 for supporting the contoured chair seat 14 and the contoured chair back at 16.

The chair seat 14 is mounted for rotation about a first horizontal axes in the form of a rod 22 extending through selected apertures 21 the seat and through aligned apertures 24 in the frame 20. Similarly the chair back 16 is mounted for rotation about a second horizontal axis in the form of a rod 23 extending through selected apertures 27 in the chair back 16 and through aligned apertures 25 in the frame 20 adjustment of the seat and back is accomplished by providing additional apertures 24 and 25. The different holes 27 for the horizontal rod 23 are used to change the location of the lumbar support of the contoured back 16 to suit each individual user.

Similarly, the axis of the seat 14 is changed by moving the rod 22 to other apertures 21 in the seat and other apertures 24 in the frame to provide the orthopaedically correct posture.

Figure 2:
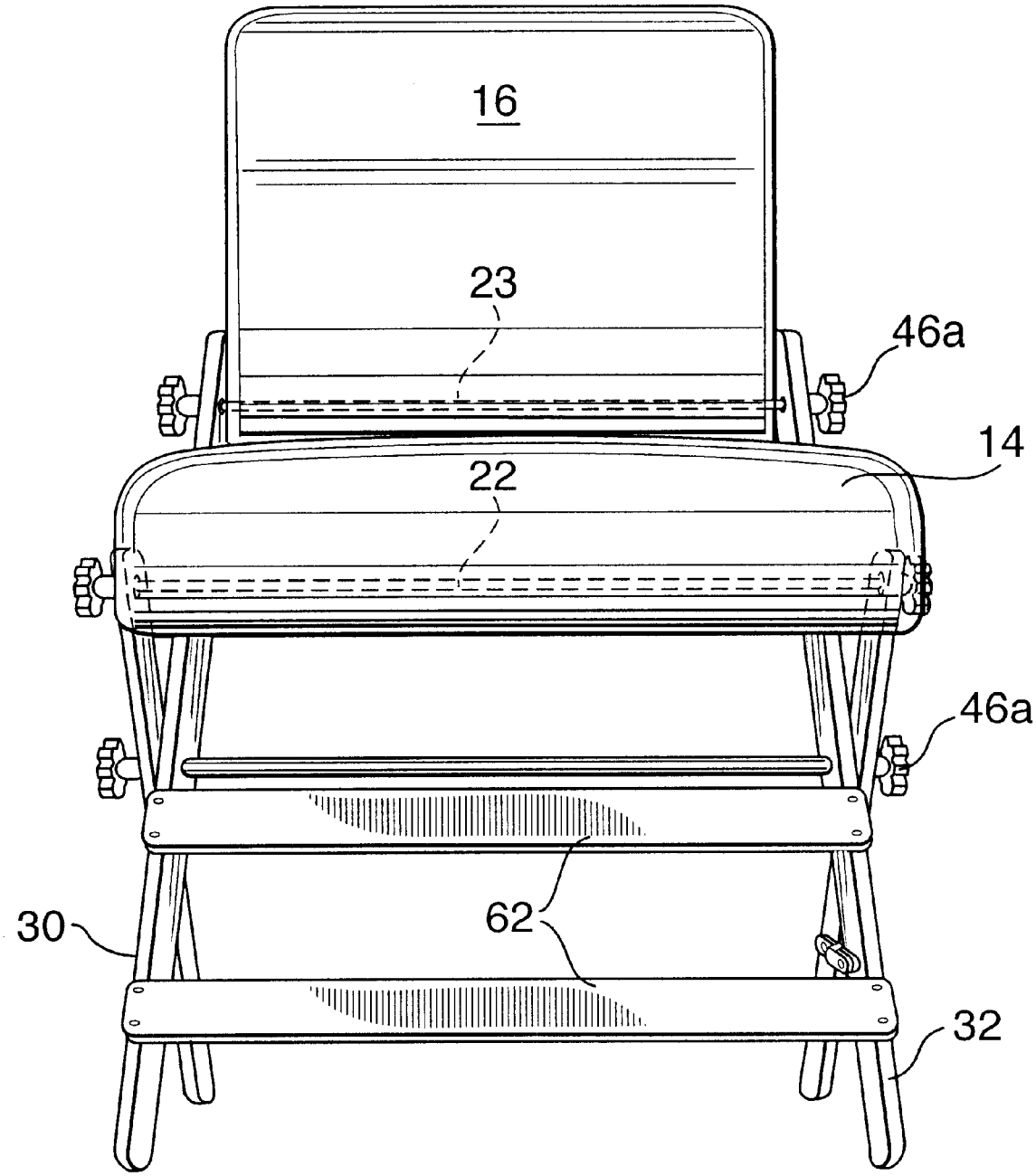
FIG. 2 is a front elevational view of the orthopaedic chair for FIG. 1.
Figure 3:
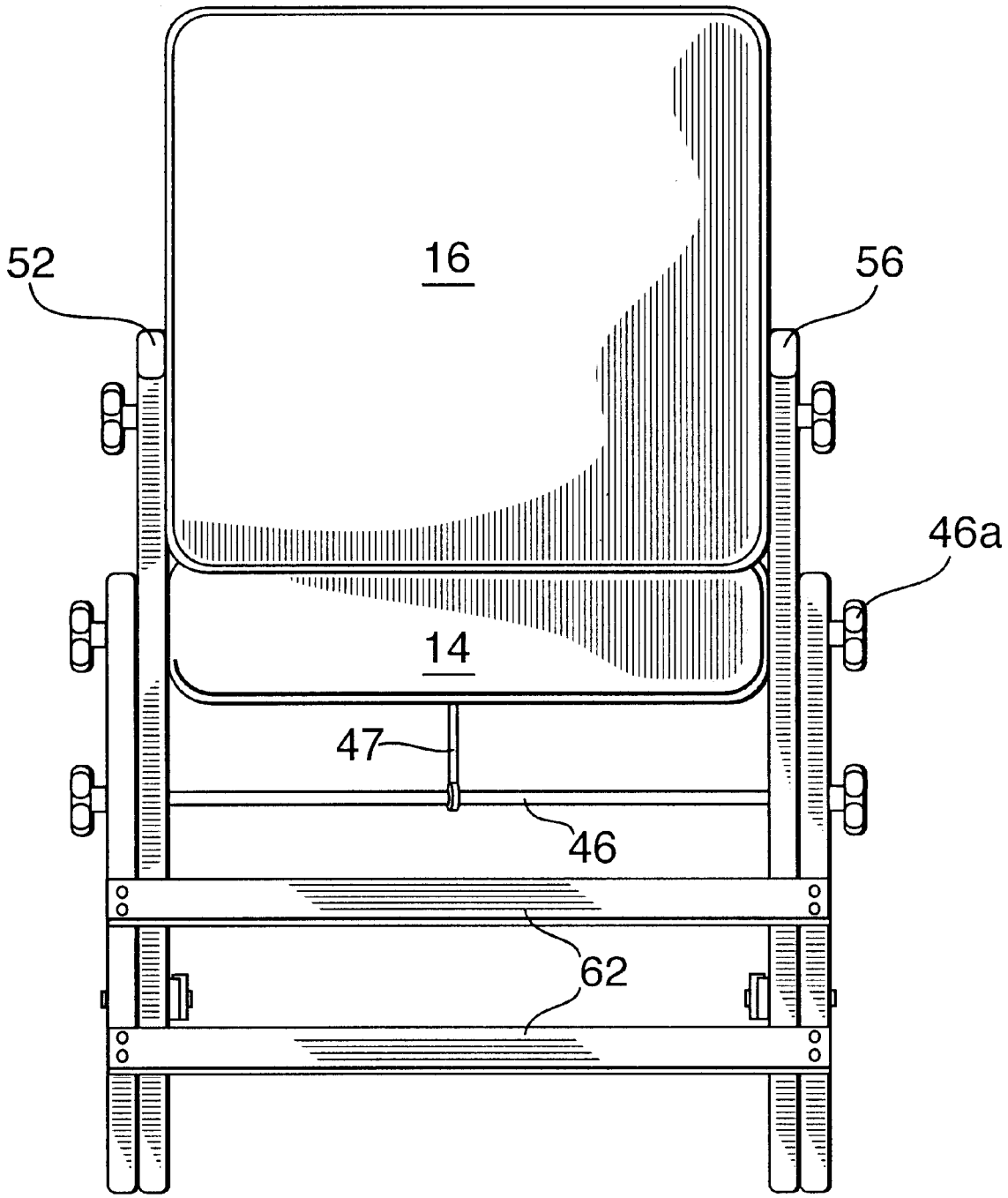
FIG. 3 is a rear view of the orthopaedic chair of FIG. 1.

As shown in FIGS. 1, 2 and 3 the frame 20 of the folding chair 10 has two has two sides 30 and 32 each having elongated members 34 and 36 and 38 and 40 respectively pivotally joined intermediate their ends such as by a rod 46 having threaded ends to receive cap nuts or the like 46*a*. A strap 47 secured to the seat 14 is releasably secured to the rod 46 as shown in FIG. 3.

The members 34, 36, 38 and 40 have a ground engaging ends 42, 44, 48 and 50 respectively and upper ends 52, 54, 56 and 58 respectively. The two sides 30 and 32 of the frame 20 are joined by cross members 62 secured by suitable fastening means to lower portions of the elongated members 34, 36, 38 & 40. Flexible tension members or folding brackets 63 limit the spread of the ground engaging ends 42, 44, 48 and 50 when the chair 10 is in use.

Figure 4:
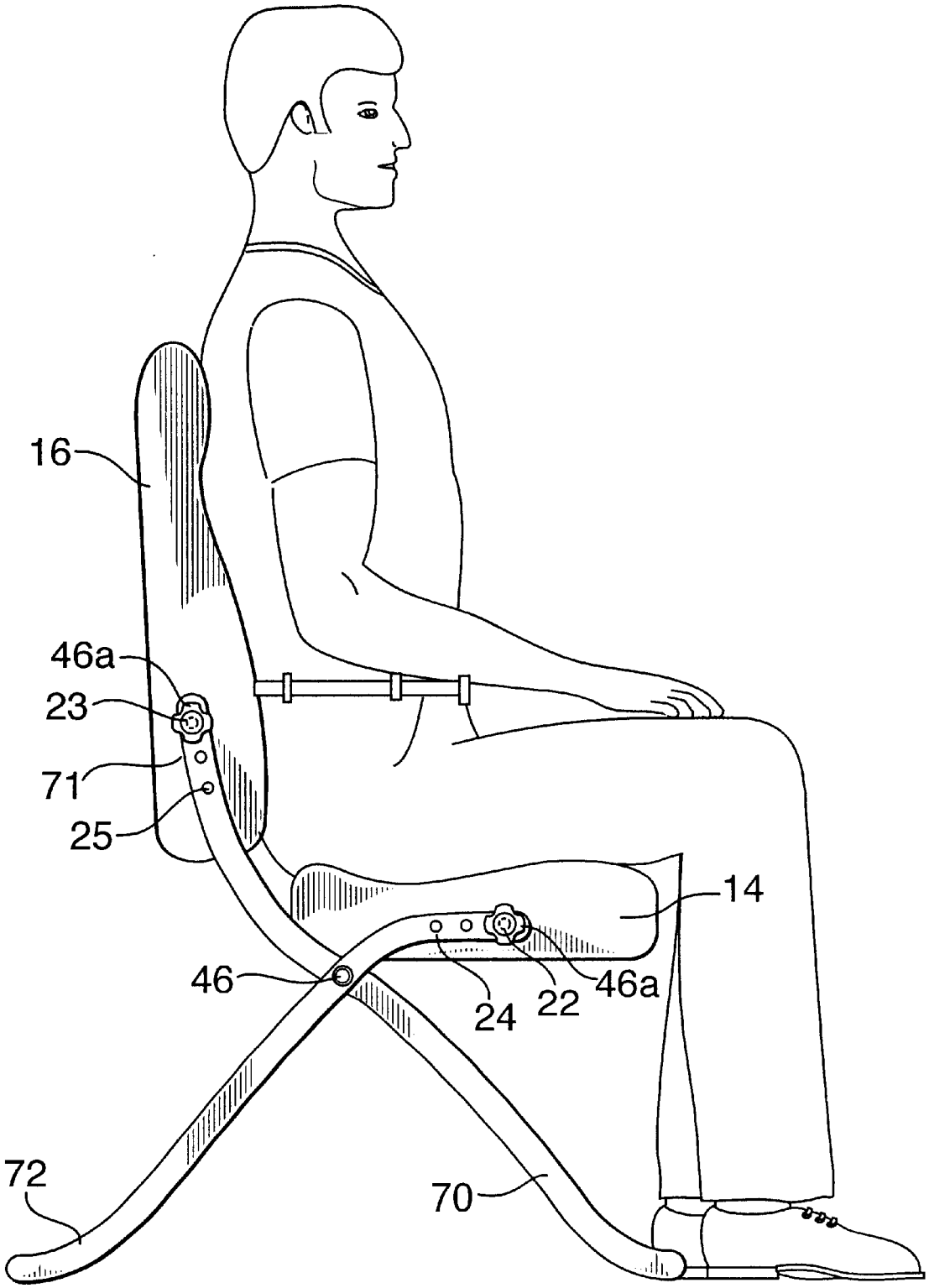
FIG. 4 is a perspective view of a modified folding chair.

FIG. 4 shows a modification of the chair 10 of FIGS. 1, 2 & 3 wherein four curved elongated side members (two of which are shown at 70 and 72) are provided. Outer ends 73 of the frame members 72 are curved at 72 to provide a substantially horizontal adjustment of the rod 22 and thus the horizontal axes of the chair seat 14. Similarly, upper ends 71 of the elongated frame members 70 are shaped to provide substantially vertical adjustment of the rod 23 and the seat back 16 through the use of selected apertures 25 and 27 as described with reference to FIG. 1.

Figure 5:
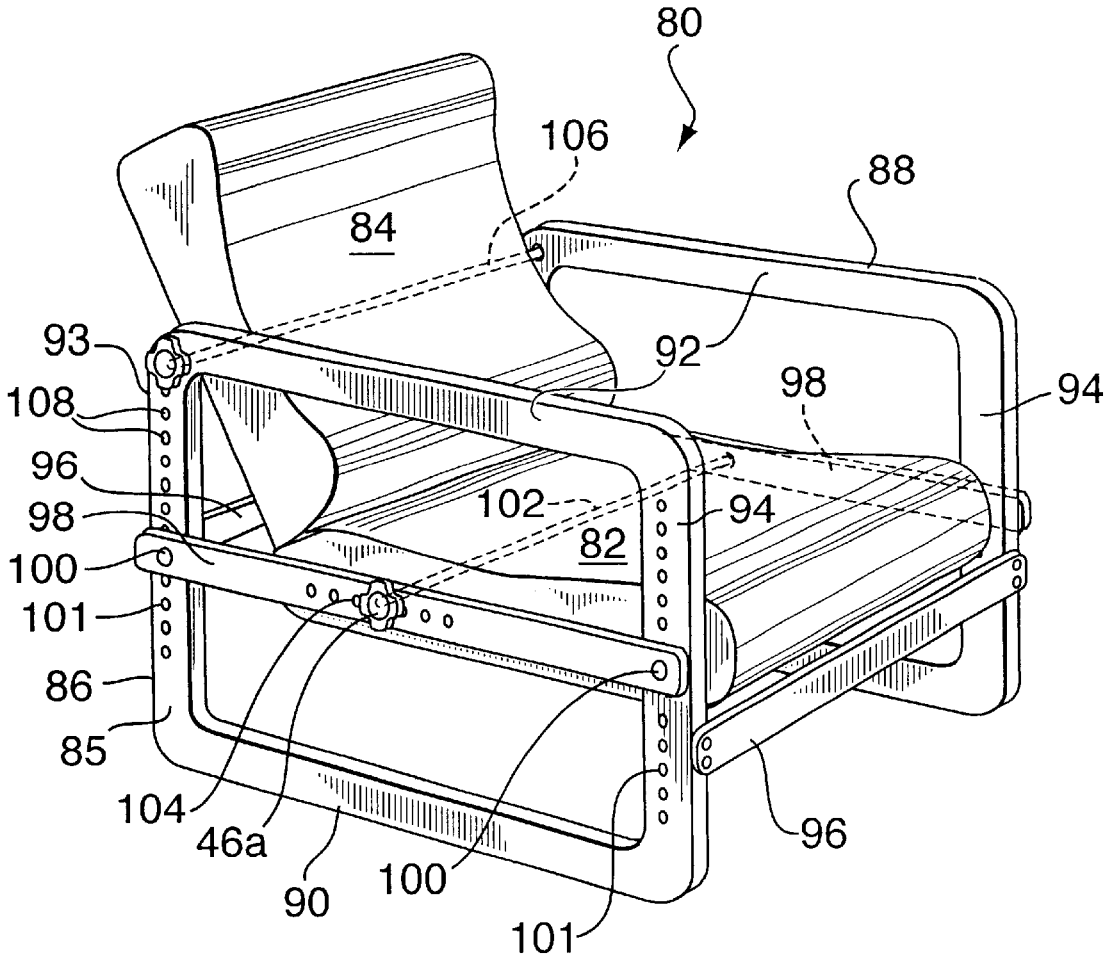
FIG. 5 is a perspective view of the orthopaedic chair of the invention in the form of an arm chair.

A further modification is that of an orthopaedic arm chair 80 shown in FIG. 5 is an example of furniture suitable for use in the home rather than in the office work station, although the arm chair 80 can also be used in offices or similar work environments.

The chair 80 includes a chair seat 82 a chair back 84 and a frame 85 for supporting the chair back 84 both of which are contoured in a manner similar to the seat 14 and back 16 of FIG. 1.

The frame 85 of the armchair 80 has two rectangular sides 86 and 88 each having a spaced apart horizontal members 90 and 92 and spaced apart vertical members 93 and 94 which are used in place of the side members 34, 36, 38 and 40 described above with reference to FIG. 1. The two sides 86 and 88 are interconnected by cross members 96 secured by suitable fastening means or methods.

Each of the sides 86 and 88 has a transverse member 98 extending from the vertical member 93 to the vertical member 94 and releasably secured there to by bolts 100 received in selected pair of the apertures 101 in the vertical members 93 and 94.

The chair seat is mounted for rotation about a first horizontal axis in the form of a rod 102 extending through selected aligned apertures 104 in the transverse members 98. The chair back is mounted for rotation on a rod 106 extending through selected aligned apertures 108 in the vertical members 93. The rods 102 and 106 have threaded ends to receive internally threaded retaining means 46*a* described with reference to FIGS. 1, 2, 3 and 4.

Figure 6:
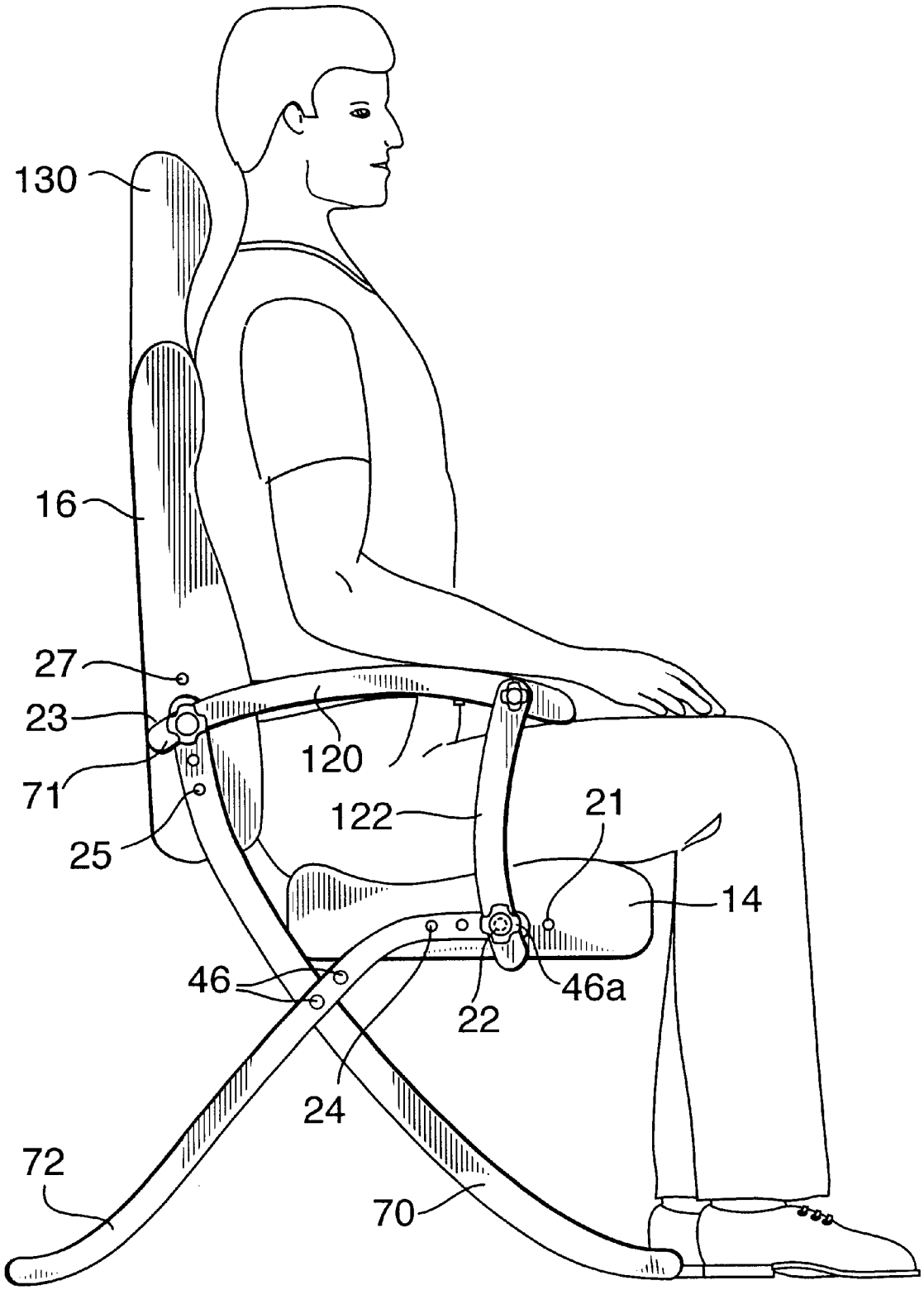
FIG. 6 is a side view of an alternative form of the chair of FIG. 4.

As shown in FIG. 6 the camp chair 10 of FIG. 4 is conveniently provided with a pair of arms 120 (one of which is shown). An inner end of the arm 120 is pivotally secured to the upper portion of the frame member 72, and an outer end of the arm 120 is pivotally attached to one end of a vertical support 122. A lower end of the vertical support 122 is pivotally secured to an upper end of the frame member 72.

The camp chair 10 of FIG. 6 is also provided with an optional removable neck rest 130 recessed to fit over the upper end of the chair back 16.

In use, changing the pivot point in the back 16 dramatically changes the type of support for the user. Lower pivot points concentrate support in the lumbar region only, while higher pivot points allow the user to spread body weight throughout the length of the back.

I claim:

1. An orthopaedic chair for a person suffering from back problems the chair includes a chair seat, a chair back and a frame for supporting the chair seat and the back, the seat being mounted for rotation about a first horizontal axis the chair back mounted for rotation about a second horizontal axes, means to provide horizontal adjustment of the first axis and the seat, means to provide vertical adjustment of the first axis and the seat, means to provide vertical adjustment of the chair back including vertical adjustment of the second axis, the chair seat and chair back being adjusted to suit an individual sitting in the chair thereby holding the person in an orthopaedically beneficial position, wherein the chair is a folding chair and said frame comprises spaced apart sides each side including first and second elongated members joined intermediate their ends by pivot means and the spaced apart sides are interconnected by cross members.

2. An orthopaedic chair for a person suffering from back problems the chair includes a chair seat, a chair back and a frame for supporting the chair seat and the back, the seat being mounted for rotation about a first horizontal axis the chair back mounted for rotation about a second horizontal axes, means to provide horizontal adjustment of the first axis and the seat, means to provide vertical adjustment of the first axis and the scat, means to provide vertical adjustment of the chair back including vertical adjustment of the second axis, the chair scat and chair back being adjusted to suit an individual sitting in the chair thereby holding the person in an orthopaedically beneficial position, wherein the chair is a folding chair and said frame comprises spaced apart sides each side including first and second elongated members joined intermediate their ends by pivot means and the spaced apart sides are interconnected by cross members and wherein the means to provide horizontal adjustment of the axis of the seat is a shaft extending through aligned apertures selected from a row of aligned apertures in a leading portion of the frame.

3. An orthopaedic chair for a person suffering from back problems the chair includes a chair seat, a chair back and a flame for supporting the chair seat and the back, the seat being mounted for rotation about a first horizontal axis the chair back mounted for rotation about a second horizontal axes, means to provide horizontal adjustments of the first axis and the seat, means to provide vertical adjustment of the first axis and the seat, means to provide vertical adjustment of the chair back including vertical adjustment of the second axis, the chair seat and chair back being adjusted to suit an individual sitting in the chair thereby holding the person in an orthopaedically beneficial position, wherein the said frames comprise spaced apart sides each side including first and second upright members joined by at least one horizontal member and horizontal members at a mid portion of the upright members between the seat and ground engaging ends of the upright members interconnecting the spaced apart sides wherein the means to provide horizontal adjustment of the axis of the seat is a shaft extending through aligned apertures selected from a row of aligned apertures in a leading portion of the frame.

* * * * *